United States Patent [19]

Reinwall, Jr.

[11] 4,029,384

[45] June 14, 1977

[54] GROUNDING CLIP

[75] Inventor: Ernest William Reinwall, Jr., McHenry, Ill.

[73] Assignee: Illinois Tool Works Inc., Chicago, Ill.

[22] Filed: May 14, 1976

[21] Appl. No.: 686,345

Related U.S. Application Data

[63] Continuation of Ser. No. 542,740, Jan. 20, 1975, abandoned.

[52] U.S. Cl. ..... 339/98

[51] Int. Cl.[2] ..... H01R 9/08

[58] Field of Search ..... 339/14, 95, 96–99, 339/256 R, 258; 24/86, 129 B, 130, 135 A; 248/71, 74 A

[56] References Cited

UNITED STATES PATENTS

| | | | |
|---|---|---|---|
| 2,969,521 | 1/1961 | Scoville | 339/258 R |
| 3,122,604 | 2/1964 | Cook et al. | 339/95 D |
| 3,683,319 | 8/1972 | Vigeant et al. | 339/97 R |
| 3,718,888 | 2/1973 | Pasternak | 339/98 |
| 3,866,996 | 2/1975 | Elkins | 339/99 R |
| 3,877,771 | 4/1975 | Jensen et al. | 339/99 R |

FOREIGN PATENTS OR APPLICATIONS

| | | | |
|---|---|---|---|
| 919,480 | 3/1947 | France | 339/97 R |
| 67,298 | 2/1951 | Netherlands | 339/97 R |

*Primary Examiner*—Joseph M. McGlynn
*Attorney, Agent, or Firm*—Olson, Trexler, Wolters, Bushnell & Fosse, Ltd.

[57] ABSTRACT

The present invention relates generally to electrical connectors for accommodating insulated conductors and more particularly to improvements in clip type connectors adapted to penetrate or strip the conductor insulation and thereafter establish contact with the conductor wire as for example to provide positive grounding of a wire to an appliance panel at any position along the length of the wire. The connector disclosed herein includes a pair of adjacently positioned arms or blades bent upwardly from the margin of a sheet metal base. The outer extremities of the spaced edges of the blades are flared to facilitate initial reception of an insulated conductor and present oppositely disposed insulation penetrating means or cutters. The outer extremities of the blades are relatively offset laterally and means is provided for mounting the connector or clip upon the edge of a panel.

1 Claim, 7 Drawing Figures

GROUNDING CLIP

This is a continuation of application Ser. No. 542,740, filed Jan. 20, 1975, now abandoned.

SUMMARY OF THE INVENTION

It is an object of the present invention to provide a unique electrical connector for accommodating insulated conductors and more particularly to improvements in clip type connectors adapted to penetrate the insulation of a conductor wire and to establish good electrical contact with the wire.

The present invention contemplates an electrical connector which is extremely simple in construction and capable of being produced from a single blank of sheet metal stock.

It is a further object of the present invention to provide a novel arrangement of laterally offset arms or blades having opposed flaring edges for initially engaging opposite peripheral surface areas of an insulated conductor so as to effect penetration of the insulation thereof and thereafter establish good electrical contact with the conductor wire.

It is also an object of the present invention to provide improved, structurally simple means in association with the above-mentioned conductor accommodating arms or blades for automatically locking the insulated conductor in position after electrical contact with the wire element has been established and for effectively counteracting unauthorized disengagement of the insulated conductor.

BRIEF DESCRIPTION OF THE DRAWING

The foregoing and other objects and advantages will be more apparent from the following detailed description when considered in connection with the accompanying drawing wherein.

DESCRIPTION OF A PREFERRED EMBODIMENT

Figure 1:
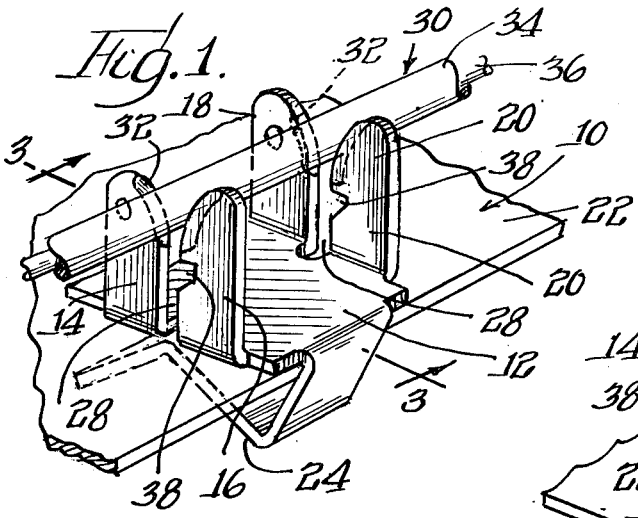
FIG. 1 is a perspective view of a clip-type connector representative of the type contemplated by the present invention, said clip being disclosed as attached to a panel, and an insulated conductor being illustrated during the initial insertion thereof between the opposed flaring edges of the gripping arms or blades.

Referring to the drawing more in detail wherein like numerals have been employed to designate similar parts throughout the various views, it will be seen that an electrical connector or clip which is representative of one embodiment of the present invention is designated generally by the numeral 10. The connector 10 may be formed from a sheet metal blank and includes a base section 12 and arms or blade members 14 and 16 extending substantially normal to the plane of the base 12 from one margin thereof. Similar blades 18 and 20 are bent upwardly from the opposite margin of the plate 12.

The connector 10 may be secured in a fixed position upon a panel 22 through the agency of a spring clip member 24 which is formed integral with the base 12 and is bent rearwardly so as to underlie the panel 22 as clearly illustrated in the drawing. Teeth or prongs 26 are formed in the member 24 and positioned in such a manner as to permit the connector to be readily slid over the margin of the panel in one direction. The impingement of the teeth 26 with the underside of the panel 22 serves to prevent unauthorized removal of the connector 10 from the panel.

Figure 6:
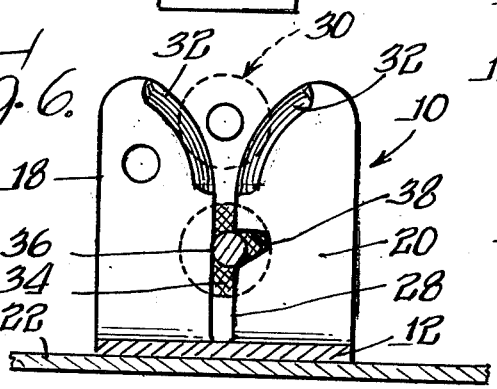
FIG. 6 is a detailed sectional view more clearly to illustrate the manner in which the electrical conductor is gripped in position when fully inserted between the blades of the clip.

Particular attention is directed to the structural features of the conductor accommodating blades 14 to 20 inclusive. It will be noted that the adjacent edges of each pair of these blades are spaced so as to provide a vertical passageway 28. The outer or upper extremities of the opposed edges of each pair of blades are flared to facilitate initial reception of an insulated conductor 30. Also, each of the blades are coined at 32 to reduce the width of the flared edges and thereby facilitate the initial penetration of the conductor insulation 34. As the insulated conductor 30 is forced downwardly from the position illustrated in FIG. 1 to the lower or final position illustrated in FIG. 6, the coined edges of the blades penetrate the conductor insulation 34 and ultimately contact the conductor wire 36 as illustrated in FIG. 6. It will also be noted that the blades of each pair are laterally deflected with respect to each other, i.e., the planes of each pair of blades diverge upwardly, so that the initial engagement of the coined edges of each pair of blades engages the conductor insulation at axially spaced areas.

It will also be noted that the blade 16 and the blade 20 are provided with notches 38. As the insulated conductor 32 reaches the lowermost position illustrated in FIG. 6, the natural tendency for the insulation 34 and the electrical conductor wire 36 is to spring to the right, FIG. 6, thereby serving to limit further downward movement of the conductor as well as inadvertent or unauthorized upward movement thereof. The initial upward divergence of the blades provides for further flexural divergence during insertion of a wire to prevent breaking thereof. Furthermore, a resilient pressure is maintained on the wire conductor so that the conductor is wedged into the notch 38 as best seen in FIG. 6, whereby the clip grips the wire conductor at three arcuately spaced locations, thereby ensuring centering of the wire among the three locations, and all of which locations tend to bite into the wire to a certain extent.

Figure 2:
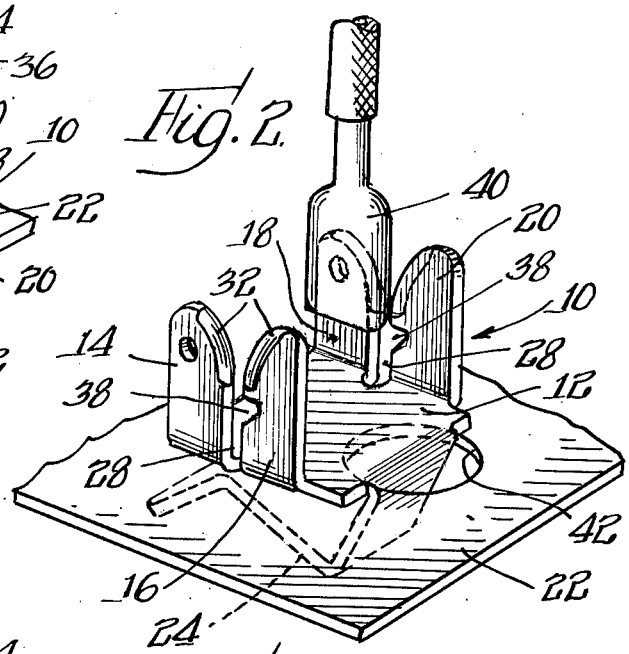
FIG. 2 is a perspective view disclosing the manner in which the connector clip of FIG. 1 may be applied to the aperture of a panel and also to the manner in which one of the arms or blades is adapted to accommodate a spade-type terminal.
Figure 3:
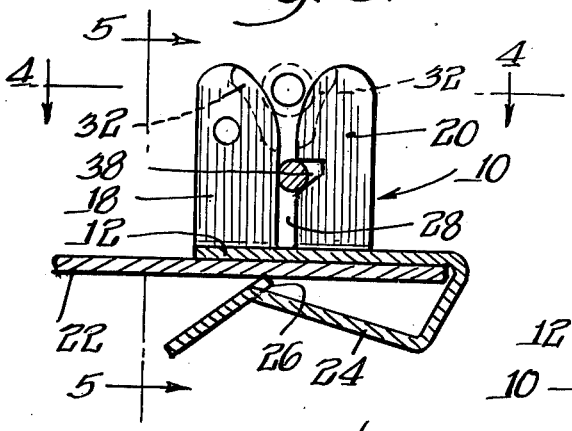
FIG. 3 is a vertical sectional view taken substantially along the line 3—3 of FIG. 1.
Figure 4:
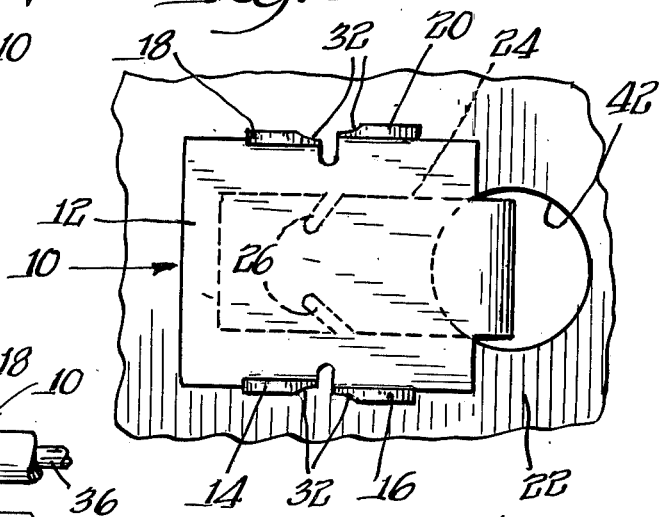
FIG. 4 is a plan view of the connector clip shown in FIGS. 1 to 3 inclusive, said clip being attached to an apertured panel.
Figure 5:
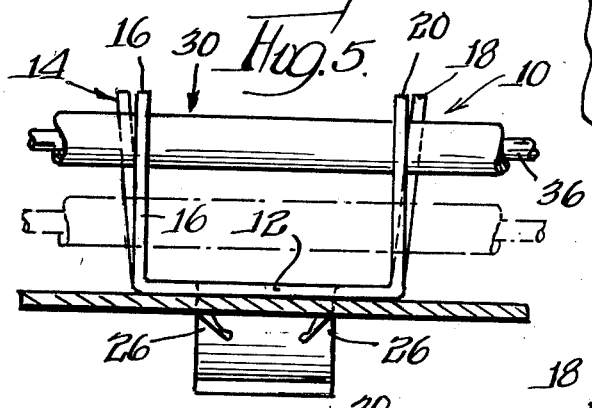
FIG. 5 is a transverse vertical sectional view taken substantially along the line 5—5 of FIG. 3, the solid line representation of the insulated conductor illustrating the initial application thereof to the connector and the dot and dash line representation indicating the final or locked position of the conductor.

In addition to accommodating the insulated conductor 30 as illustrated in FIGS. 1, 5 and 6, one of the blades, as shown in FIG. 2, is of a size adapted to telescopically accommodate a standard spade type terminal member 40. It will also be understood that the blade members are sufficiently resilient to insure a limited amount of edgewise deflection in response to the association therewith of the insulated conductor 30 or the spade type terminal member 40. In FIGS. 1, 3 and 5, the connector 10 is disclosed in association with a margin of the panel 22. In instances where it is desirable, an aperture 42, FIGS. 2 and 4, may be provided in the panel 22 to accommodate the clip section 24.

Figure 7:
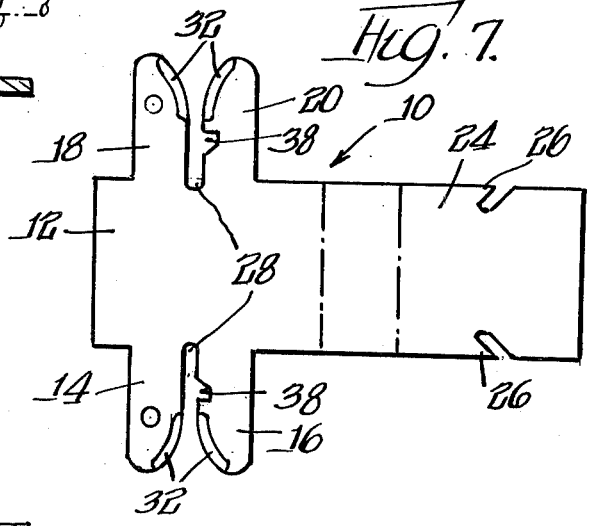
FIG. 7 is a plan view of a sheet metal blank from which the above-mentioned electrical connector clip may be formed.

From the foregoing, it will be apparent that the present invention contemplates a connector which may be produced very economically. Thus as shown in FIG. 7, a one piece sheet metal section or blank may be formed to provide the aforesaid connector 10. The present invention has a very practical application in instances where it is essential to positively ground a wire to an applicance panel and eliminates the necessity of measuring wires, cutting them to length, stripping insulation and attaching spade terminals. The arrangement of the notches 38 in the blades 16 and 20 assure automatic retention of an inserted insulated conductor and also assure good electrical contact of the edges of the opposite blades 14 and 18 with the conductor wire 36. The arrangement of the locking prongs or barbs 26 is such as to secure the connector against unauthorized dislodgment from the panel and also to facilitate the ease with which the connector may be initially applied to the panel. The coined surfaces 32 and the axial spaced relation of each pair of said coined surfaces contribute to the efficient penetration of the conductor insulation.

While for purposes of illustration, certain structural features have been disclosed herein, it should be understood that the present invention contemplates modifications and changes without departing from the spirit and scope of the appended claims.

The invention is claimed as follows:

1. An electrical connector for receiving an insulated electrical conductor having a central conductor and an insulating cover, comprising an electrically conductive plate-like base, two pairs of adjacently positioned blades extending substantially normal to and formed integral with said base, adjacently spaced edges of each pair of said blades defining parallel vertical passageways spaced for receipt of said insulated conductor therebetween and for cutting through said insulation, at least one of each pair of blades being shaped for insertion into a standard spade-type terminal member, the upper edges of each pair of blades converging inwardly toward a respective passageway, said edges being coined to a reduced width to facilitate penetration into said insulating cover of said electrical conductor when said conductor is forced between said flared edges, each said blade being substantially planar and the planes of each pair of blades relatively diverging outwardly from said base resiliently to accommodate oversize electrical conductors and spacing the coined edges to cut through the conductor insulation into engagement with the conductor at axially spaced close-coupled areas predetermined by the divergence of the blades, and a single notch in the edge of one of said blades of each pair thereof, an outer margin of said notch extending inwardly from and perpendicular to the edge of said blade and an inner margin extending obliquely along a segment thereof and opening into said passageway opposite an unnotched central conductor contacting edge of the other blade, said unnotched blade edge and said notch margins providing a three-point wedging engagement for said central conductor.

* * * * *